US006039201A

United States Patent [19]

Kesterman et al.

[11] Patent Number: 6,039,201

[45] **Date of Patent: *Mar. 21, 2000**

[54] REINFORCING FLANGE FOR UNDERGROUND SUMP

[75] Inventors: James Kesterman, Cincinnati; David Pendleton, Fairfield, both of Ohio

[73] Assignee: Delaware Capital Formations, Inc., Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/938,401

[22] Filed: Sep. 26, 1997

[51] Int. Cl.[7] ..... B65D 25/00

[52] U.S. Cl. ..... 220/484; 220/669; 141/86

[58] Field of Search ..... 220/648, 649, 220/641, 642, 643, 659, 669, 672, 567.1, 567.2, 4.13, 484; 141/86

[56] References Cited

U.S. PATENT DOCUMENTS

| | | | |
|---|---|---|---|
| 3,160,306 | 12/1964 | Smalley | 220/669 X |
| 4,065,020 | 12/1977 | Carson | 220/484 |
| 4,163,503 | 8/1979 | McKinnon | 220/484 |
| 4,367,821 | 1/1983 | Holt | 220/659 |
| 5,257,652 | 11/1993 | Lawrence . | |
| 5,320,248 | 6/1994 | Jamieson, III | 220/669 |
| 5,503,088 | 4/1996 | Hayman | 220/484 X |
| 5,806,702 | 9/1998 | Sabo | 220/4.13 X |

*Primary Examiner*—Steven Pollard
*Attorney, Agent, or Firm*—Dinsmore & Shohl LLP

[57] ABSTRACT

A container such as a sump having a bottom, at least one wall extending upwardly from the bottom, and a flange connected to the at least one wall and projecting therefrom. The flange preferably has apertures extending partially into the interior portion of the flange from its exterior surface. The flange provides structural rigidity to the container and prevents irregularities from being formed in the walls during manufacture. Preferably, the container is a sump having four lower walls, four upper walls integrally connected to the lower walls by the flange, and four entrance walls integrally connected to the upper walls and defining a mouth for receiving fluids. The flange preferably has an upper surface having upper apertures and a lower surface having lower apertures that are axially aligned with the upper apertures. Pins may utilized during manufacture of the sump by rotational molding to form apertures within the flange and aid in preventing irregularities from being formed.

16 Claims, 4 Drawing Sheets

REINFORCING FLANGE FOR UNDERGROUND SUMP

TECHNICAL FIELD

The present invention relates generally to containers such as dispenser sumps and the like, and is particularly directed to a container having a flange connected to the walls of the container for providing strength and rigidity to the container and for preventing distortion of the walls when the container is molded.

BACKGROUND OF THE INVENTION

Typically, containers such as sumps are placed beneath fluid conduit systems to contain fluids which may leak from the systems. For example, gasoline service stations usually include an underground fueling network of dispenser sumps, fuel conduits and entry fittings. Such sumps usually comprise a plastic or metal shell which is buried in backfill and/or cement such that the mouth of the sump is open to air at the level of the surface. The sumps are used to capture gasoline which may leak from fuel conduits and dispensers located above the sump. Containment of such leakage prevents gasoline from contaminating the ground and ground water. To prevent leaked fluid from seeping back out of the sump, entry fittings are used at locations where pipes enter the sump. These fittings also prevent the flow of ground water into the sump. In order to maintain a tight seal between the sump wall and the entry fitting, the wall must be sufficiently flat and free from irregularities. After the sump captures leaked fuel, a liquid removal apparatus can be inserted into the sump to remove the fuel.

In addition to serving to capture leaked fuel, sumps also serve to provide access to the fuel pipes and associated couplings of the fuel system. After installation of the sump, individuals may enter the sump to maintain fuel and entry fittings. Thus, the sump must be sufficiently rigid to maintain shape integrity despite the backfill surrounding the sump and the weight of the individuals who may enter it.

While many advancements have been made in the field of underground sumps, a number of problems still exist. Among the problems experienced with such containers is their tendency to deform under the weight of the backfill and/or maintenance personnel. Such deformations can result in the rupturing of the sump, thereby creating the risk that fuel will be emitted into the surrounding environment. Furthermore, deformations of the sump can jeopardize the integrity of the entry fitting seals, again creating the risk of contamination to the environment.

Another problem experienced by manufacturers of such sumps is the difficulty in manufacturing a sump with walls sufficiently flat to maintain a tight seal between the entry fitting and the sump. Rotational molding processes are commonly used to manufacture sumps. A rotational molding process involves inserting powdered plastic into a rotating mold. During the rotation, the powdered plastic becomes heated and takes on the shape of the mold. When allowed to cool, the plastic hardens thereby creating the sump defined by the mold. Although this process has been found to be highly efficient and inexpensive, it is not without disadvantages. Unfortunately, the process often results in undesirable variations in the thickness and shape of the sump walls and the formation of irregularities on sump surfaces. These problems are believed to occur during the cooling of the plastic. Due to these disadvantages, it is often difficult to maintain a sealing relationship between an entry fitting and the wall of a sump formed by this process.

Consequently, despite significant work undertaken in the industry and the ongoing problems with sump deformation and leakage, heretofore there has not been provided a relatively inexpensive sump that can withstand large compressive forces and provides tight sealing of entry fittings.

SUMMARY OF THE INVENTION

Accordingly, to overcome the above and other problems, it is an object of the present invention to provide a container such as a sump which is rigid enough to resist deformation when exposed to compressive forces.

It is another object of this invention to produce a sump that has walls that are substantially free from irregularities such that tight seals may be maintained between the walls and entry fittings placed therein.

It is a further object of the present invention to provide an efficient and cost-effective method for producing a sump that is resistant to deformation and has walls that are substantially free from irregularities.

Another object of the present invention is to utilize a rotational molding process to produce a sump having the above-described qualities. It is an object of the present invention to obviate the above-described problems.

To achieve the foregoing and other objects and in accordance with the purposes of the present invention as described above, the present invention is directed to a reinforced container for receiving and storing fluids. The reinforced container comprises a bottom, at least one wall extending upwardly with respect to the bottom, the at least one wall and bottom forming an at least partially enclosed space, and a flange connected to either the exterior or interior of the at least one wall and projecting therefrom. The flange has an exterior surface, an interior portion, and at least one cavity at least partially extending into the interior portion of the flange from the exterior surface.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different, obvious aspects all without departing from the invention. Accordingly, the drawings and description should be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENTS

Figure 1:
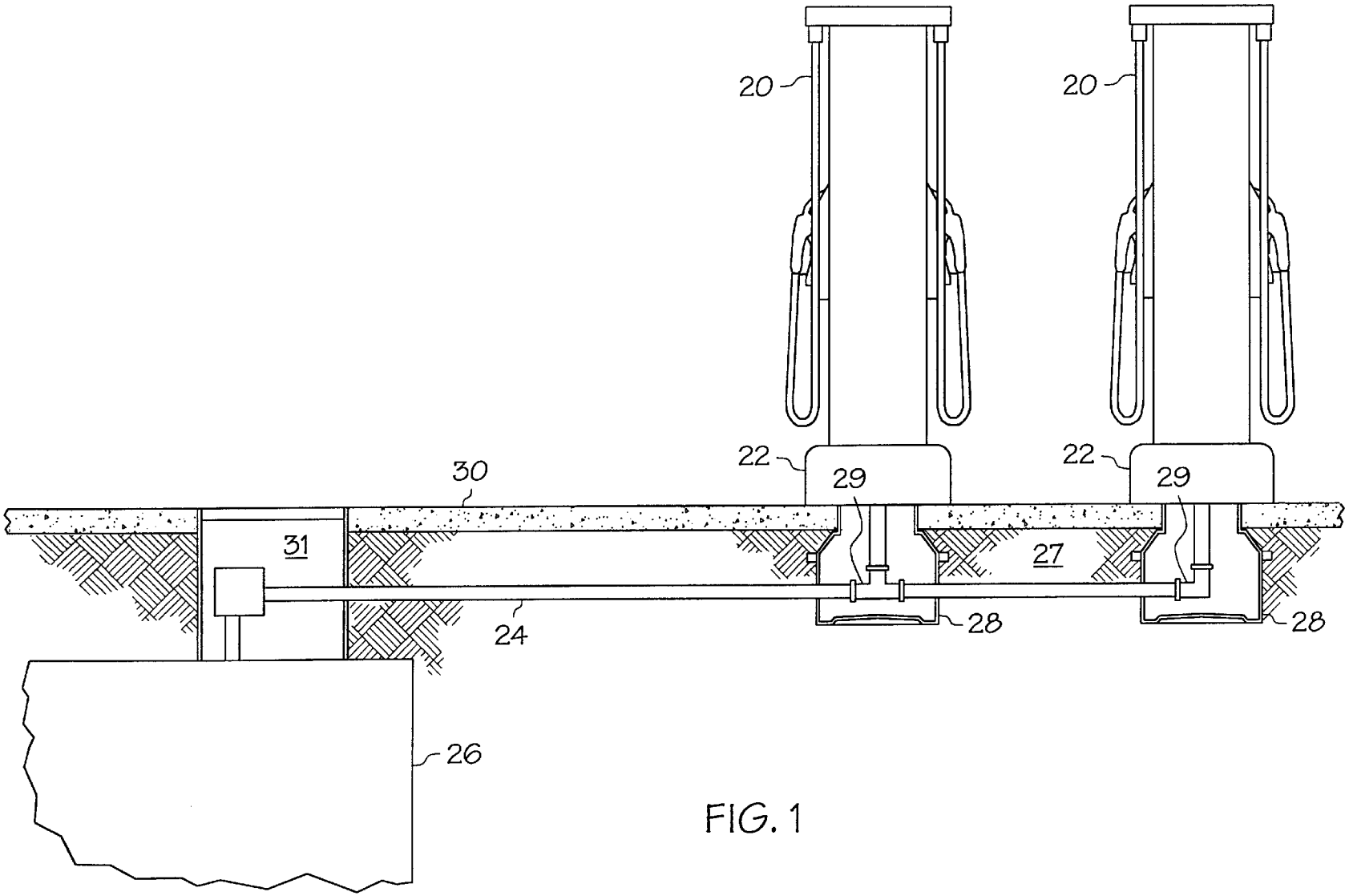
FIG. 1 is a plan view of a fuel dispensing system utilizing a dispenser sump.

Referring now to the drawings, FIG. 1 is a plan view of an underground fuel distribution system utilizing a preferred dispenser sump 28 of the present invention. In the system, fuel from an underground fuel tank 26 is delivered to the fuel dispensers 20 through the fuel pipe 24, upon demand from the dispensers. The underground fuel tank 26 can be replenished through the access space 31. A sump 28 is positioned under each fuel dispenser 20. The upper portions of the sumps 28 extend upwardly through the cement islands 22. The lower portions of sumps 28 are surrounded by backfill 27.

The sumps 28 provide chambers to access the pipe fittings 29 and pipe 24 which are located beneath the surface of the pavement 30. The sumps 28 can be accessed through door (not shown) in the fuel dispensers 20 or by removing the dispensers from the islands 22. In addition to providing access to underground components, the sumps 28 are designed to contain any fuel that may have leaked or been spilled from the dispensers 20. Leaked fuel contained by either sump 28 can be removed by inserting fuel removal apparatus through the access door of the dispenser 20 and into the sump. The sumps 28 must be rigid enough to withstand the impact of backfill 27 when it is initially loaded about the sump, as well as the continuous pressure exerted by the backfill when the fuel distribution system is in operation. Furthermore, the sumps 28 must be rigid enough to withstand the pressure exerted when maintenance personnel enter the sump to service the distribution system.

Entry fittings (not shown) are used to seal the interfaces between the sumps 28 and the openings where the fuel conduits 24 enter and exit the sump. These entry fittings prevent the flow of any fuel that may be contained in the sump from entering the surrounding ground. In addition, the fittings prevent ground water from entering the sump 28. Thus, the walls of the sumps 28 must be sufficiently flat and free from irregularities so that the entry fittings provide a tight seal about the conduit 24.

Figure 2:
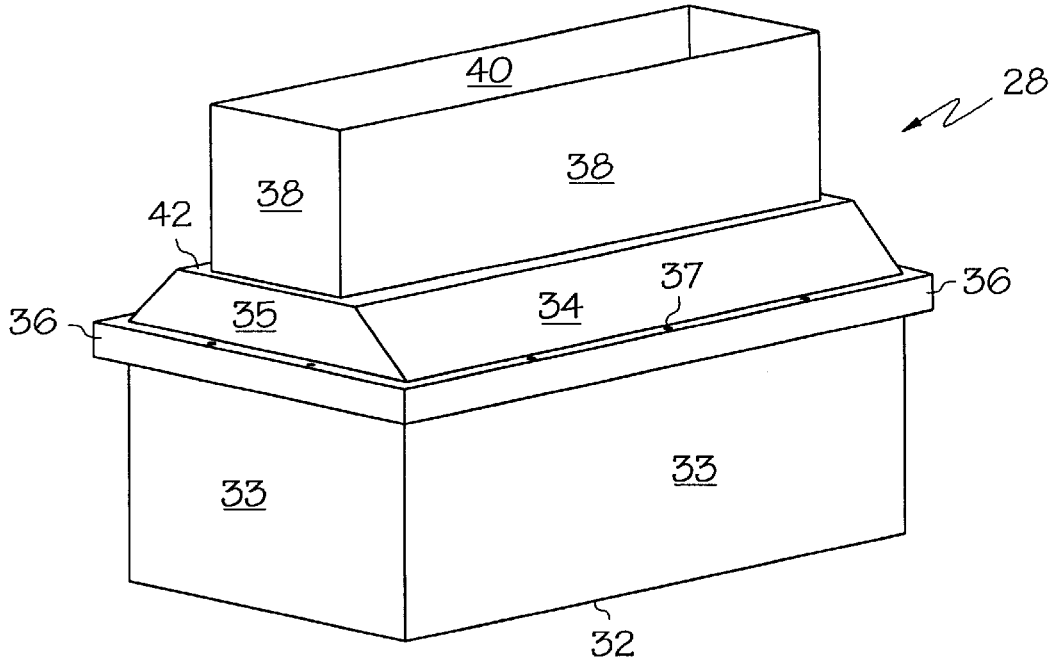
FIG. 2 is a perspective view of a sump according to one embodiment of this invention.

FIG. 2 is a perspective view of preferred dispenser sump 28. As shown in the figure, sump 28 preferably includes a bottom 32 and four lower walls 33 extending upwardly and perpendicularly with respect to the bottom. A flange (or belt portion) 36 connects these lower walls 33 to four upper walls 34 and 35 that extend upwardly with respect to the lower walls. The flange 36 can have cavities or apertures (known in the art as kissoffs) 37 that extend partially into the interior portion of the flange from the exterior surface of the flange. Preferably, and as shown in FIG. 2, the flange extends radially outwardly with respect to lower walls 33 and upper walls 34 and 35. The flange 36, provides structural rigidity to the sump 28 making it more resistant to the impact of forces directed upon it by backfill 27 and/or maintenance persons.

As also depicted in the preferred embodiment of FIG. 2, the sump 28 can have entrance walls 38 that extend upwardly with respect to the upper walls 34 and are connected to the upper walls by a ledge 42. The entrance walls 38 define a mouth (or opening) 40 which can be positioned below the fuel dispenser 20 (as shown in FIG. 1) to collect fluid which may have leaked or spilled from the dispenser. The lower walls 33, upper walls 34 and 35, and entrance walls 38 define an enclosure having a first end and a second end. The first end defines the mouth 40 and the second end is closed off by the bottom 32.

Figure 3:
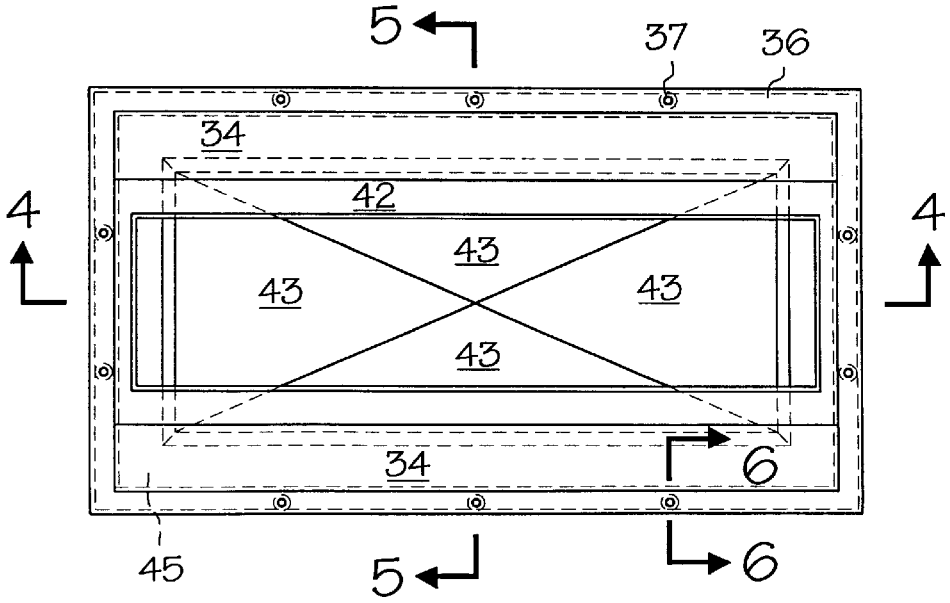
FIG. 3 is a top view of the sump shown in FIG. 2.

FIG. 3 shows a top view of the preferred embodiment depicted in FIG. 2. As best shown in this figure, the bottom 32 preferably includes a deflection surface that includes panels 43. It is also preferred that the bottom 32 have a distribution channel 45. Liquid impinging upon the deflection surface is deflected to the distribution channel 45 where it spreads out along the channel about the periphery of the sump bottom 32, as disclosed in U.S. patent application Ser. No. 08/728,255, the entire specification of which is incorporated herein by reference. From FIG. 3, it is also apparent that, preferably, the apertures 37 in the flange 36 are circular in shape and are located intermittently along the length of the flange. However, it is to be understood that the apertures 37 may be of shapes other than circular without departing from the scope of the invention. As also shown in the figure, the flange 36 preferably extends about the entire periphery of the sump 28 and is joined in a rectangular configuration.

Figure 4:
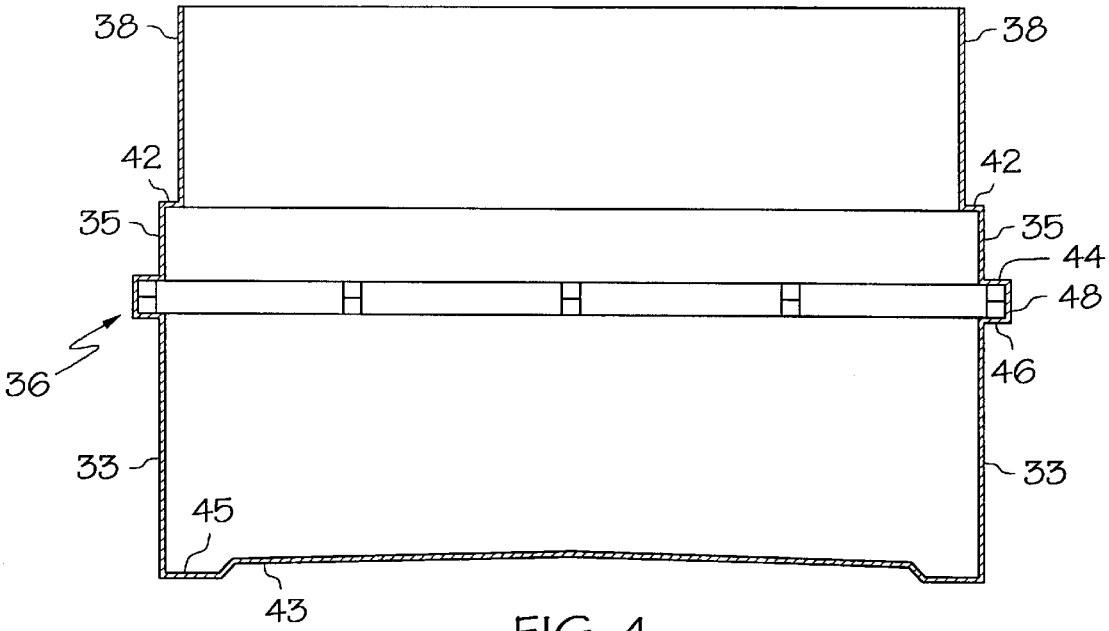
FIG. 4 is a cross-sectional view of the sump shown in FIG. 3 taken along line 4—4 of FIG. 3.
Figure 5:
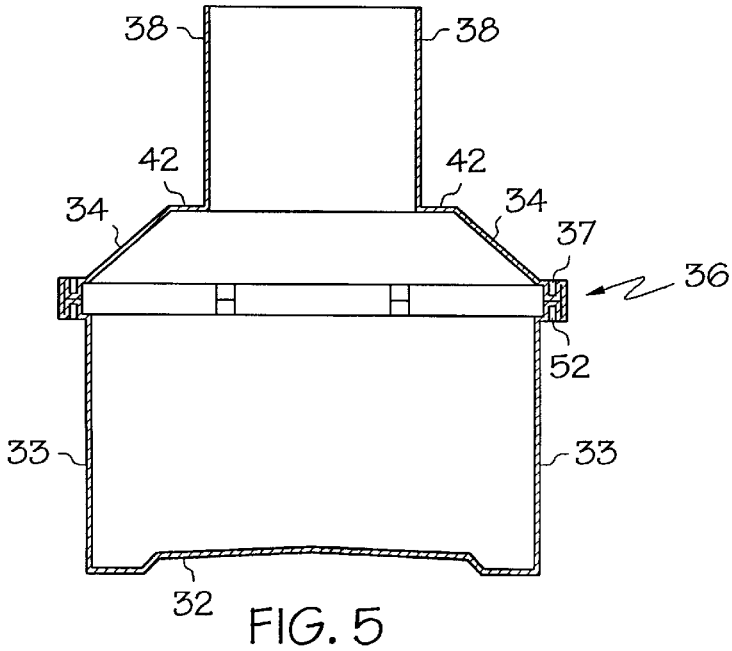
FIG. 5 is a cross-sectional view of the sump shown in FIG. 3 taken along line 5—5 of FIG. 3.

FIG. 4 is a cross-sectional view of the sump 28 taken along line 4–4 of FIG. 3. FIG. 5 is a cross sectional view taken along line 5–5 of FIG. 3. As shown in FIG. 4 and FIG. 5, the exterior surface of the flange 36 preferably includes an upper surface 44, a lower surface 46, and side surface 48 that integrally connects the upper surface to the lower surface. The upper surface 44 is integrally connected to the upper walls 34 and 35. The lower surface 46 is integrally connected to the lower walls 33. As also seen in these figures, preferably, the upper surface 44 and lower surface 46 are substantially horizontal while the side surface 48 is substantially vertical. However, it is to be understood that the exterior surface of the flange 36 may take on other configurations without departing from the scope of the invention.

As best shown in FIG. 4 and FIG. 5, the entrance walls 38 of the embodiment are integrally connected to the upper walls 34 and 35 by ledge 42 and are parallel with respect to the lower walls 33. As seen in FIG. 4, the two upper walls 35 are preferably integrally connected to two of the lower walls 33 by the flange 36. In addition these two upper walls 35 are preferably parallel with respect to the lower walls 33. As seen in FIG. 5, the two upper walls 34 are preferably integrally connected to the two lower walls 33 by the flange 36 and are preferably oblique with respect to the lower walls 33. However, it should be understood that, although the walls 33, 34, and 35, and flange 36 are depicted as being joined in a rectangular configuration, the sump 28 may take on other configurations without departing from the scope of the present invention.

Figure 6:
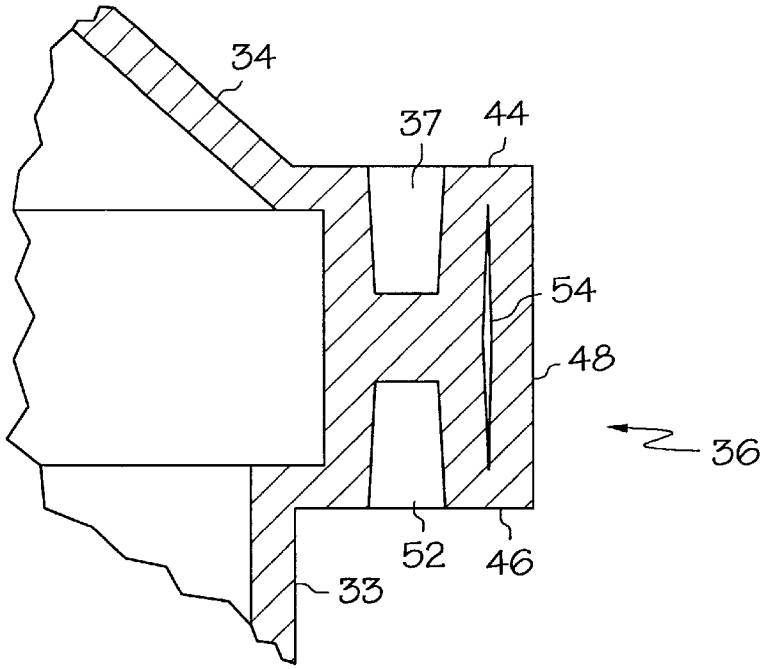
FIG. 6 is a cross sectional view of the flange of the sump shown in FIG. 3 taken along line 6—6.

FIG. 6 is a cross-sectional view of the representative embodiment of FIG. 3 taken along line 6–6, showing a preferred configuration for the flange 36. As shown in FIG. 6, it is preferred that the upper apertures 37 extend partially into the interior portion of the flange 36 from the upper surface 44. Similarly, lower apertures 52 preferably extend partially into the interior portion of the flange 36 from the lower surface 46. Each lower aperture 52 corresponds with an upper aperture 37 and is substantially axially aligned therewith. Each upper aperture 37 and lower aperture 52, along with the solid portions of the flange 36 between the two apertures, define a column which helps provide strength and rigidity to the sump 28 as it is subjected to the various forces that may act upon it. As noted earlier and as shown in FIG. 6, the flange 36 is preferably integrally connected to the upper walls 34 as well as the lower walls 33.

It is preferred that the sump 28 comprise a linear medium density polyethylene plastic material having a coloring agent, an ultraviolet stabilizer, and an antistatic agent added thereto. It is also preferred that the sump be formed by a rotational molding process. During such a process, powdered plastic is inserted into a mold of the shape of the sump 28. The mold is then rotated until melting or fusion occurs and the fluidized plastic is dispersed over all inner surfaces of the mold. When cooled, the plastic hardens to form the sump 28, which is removed from the mold. Preferably, the mold comprises two halves.

Figure 7:
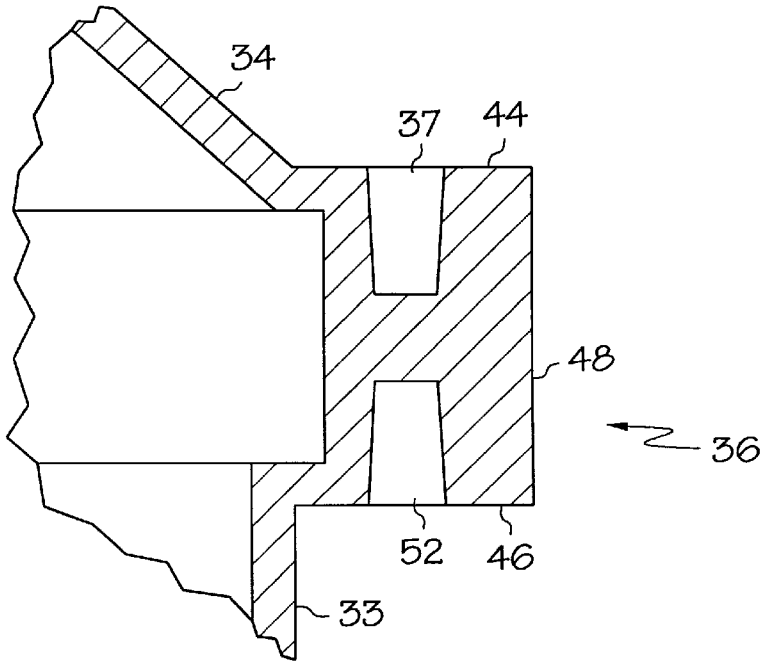
FIG. 7 is a cross-sectional view of an alternative embodiment of the flange of the present invention.

As shown in FIG. 6, a rotational molding process can sometimes result in small slits 54 being formed in the interior of the flange 36 (or in other areas of the sump) near the locations where pins are inserted. This slit 54 is caused when the plastic does not completely fill in areas on the exterior side of the pins. However, as shown in FIG. 7, the sump 28 may be substantially free of such slits without departing from the scope of the invention.

To form the flange 36, the mold is configured with a portion that extends from the lower walls of the mold at the desired location, such that plastic will disperse within this portion during the formation process. To form the apertures 37 and 52, prior to the insertion of the powdered plastic, pins may be inserted into the mold along this portion of the mold corresponding to the flange 36. Preferably, these pins comprise a metal or hard plastic material. During the rotational molding process, the use of a mold having a flange 36, as well as the use of pins to form apertures 37 and 52, help to maintain the structural integrity of the sump 28, thereby creating flatter surfaces with fewer irregularities. It is believed that the pins and flange 36 help to anchor the fluidized plastic as it cools, thereby preventing the warping of the sump walls. As noted earlier, warping and irregularities in the lower walls 33 of the sump 28 are particularly undesirable because these walls are required to be substantially flat so that entry fittings placed therein may operate properly. The flange 36 and apertures 37 and 52 also improve the structural rigidity of the sump 28 when under stress from the weight of the backfill 27 and/or maintenance personnel who may enter the pump to service pipes and fittings therein. Thus, sump 28 according to this invention achieves a marked improvement over conventional sumps by providing flatter surfaces and greater rigidity.

While the invention has been described with respect to a sump having a flange for reinforcement, it should be understood that the flange of the present invention may be utilized on containers other than sumps, such as fuel tanks and underground storage containers, without departing from the scope of the invention. It is to be further understood that, although the flange has been described as having apertures, the flange may provide the structural rigidity of this invention with or without apertures.

The foregoing description of one preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention and various embodiments and with various modifications as are suited to the particular use contemplated. It is intended that the scope of the invention be defined by the claims appended hereto.

What is claimed is:

1. A reinforced container for receiving and storing fluids, comprising:

a bottom;

at least one will extending upwardly with respect to the bottom, the at least one wall and bottom forming an al least partially enclosed space;

at least one upper wall extending upwardly with respect to the at least one wall; and a flange connected to either the exterior or interior of the at least one wall and connecting the at least one wall to the at least one upper wall;

the flange having an exterior surface comprising an upper surface connected to the at least one upper wall, a lower surface connected to the at least one wall, and a side surface connecting the upper surface and the lower surface; an interior portion; and at least one cavity at least partially extending into the interior portion of the flange from the upper surface.

2. A reinforced container according to claim 1, wherein the at least one wall comprises four lower walls joined in a rectangular configuration.

3. A reinforced container according to claim 1, wherein the flange is integrally connected to the at least one wall.

4. A reinforced container according to claim 1, wherein the at least one upper wall comprises four upper walls joined in a quadrangular configuration, and further wherein the at least one wall comprises four lower walls joined in a quadrangular configuration, each upper wall being integrally connected to a lower wall by the flange.

5. A reinforced container according to claim 1, wherein a plurality of cavities extend at least partially into the interior portion of the flange from the upper surface, the cavities being located intermittently along the length of the flange.

6. A reinforced container according to claim 5, wherein the flange has a corresponding cavity axially aligned with each cavity extending from the upper surface, each corresponding cavity extending partially into the interior portion of the flange from the lower surface.

7. A reinforced underground sump for resisting deformation, comprising:

a bottom;

an enclosure having a plurality of lower walls joined in a polygonal configuration and extending upwardly with respect to the bottom and a plurality of upper walls extending upwardly with respect to the lower walls; and a belt portion at least partially circumscribing the enclosure and integrally connecting the lower walls to the upper walls;

the belt portion having an exterior surface comprising a substantially horizontal top surface integrally connected to the upper walls, a substantially horizontal bottom surface integrally connected to the lower walls, and a substantially vertical side surface integrally connecting the upper surface and the lower surface; an interior portion; and at least one aperture extending partially into the interior portion from the upper surface, wherein the belt portion has a corresponding aperture axially aligned with each aperture extending from the upper surface, each corresponding aperture extending partially into the interior portion from the lower surface, the belt portion being operative for providing structural rigidity to the enclosure.

8. A reinforced underground sump according to claim 7, wherein a plurality of apertures extend at least partially into the interior portion of the belt portion from the exterior surface, the apertures being disposed intermittently along the length of the belt portion.

9. A reinforced sump for containing fluids, comprising:

a bottom;

a plurality of lower walls joined in a polygonal configuration and extending upwardly with respect to the bottom;

a plurality of upper walls joined in a polygonal configuration and extending upwardly with respect to the lower walls; and a flange joined in a polygonal configuration and connecting the upper walls to the lower walls;

the flange having an exterior surface, an interior portion, and at least one aperture at least partially extending into the interior portion of the flange from the exterior surface, the flange extending radially outwardly with respect to the lower walls and the upper walls.

10. A reinforced sump according to claim 9, wherein the exterior surface of the flange comprises an upper surface connected to the upper walls, a lower surface connected to the lower walls, and a side surface connecting the upper surface and lower surface.

11. A reinforced sump according to claim 10, wherein the flange is provided with a plurality of upper apertures located intermittently along the length of the flange and each upper aperture extends partially into the interior portion of the flange from the upper surface.

12. A reinforced sump according to claim 11, wherein the flange is provided with a plurality of lower apertures located intermittently along the length of the flange and each lower aperture extends partially into the interior of the flange from the lower surface in axial alignment with an upper aperture.

13. A reinforced sump according to claim 12, wherein each upper aperture, its corresponding lower aperture, and material therebetween define a column, the column being operative for resisting deformation of the lower walls and center walls.

14. A reinforced sump according to claim 9, wherein the sump further comprises a plurality of entrance walls connected to the upper walls and extending upwardly therefrom, the plurality of entrance walls being substantially parallel to the plurality of lower walls and defining an opening for receiving fluids.

15. A reinforced sump according to claim 14, wherein the interior portion of the flange defines a slit which extends continuously along the length of the flange.

16. A reinforced sump according to claim 15 wherein at least one of the upper walls extends obliquely from the lower walls.

* * * * *

UNITED STATES PATENT AND TRADEMARK OFFICE

CERTIFICATE OF CORRECTION

PATENT NO. : 6,039,201
DATED : March 21, 2000
INVENTOR(S) : James Kesterman and David Pendleton It is certified that error appears in the above-indentified patent and that said Letters Patent is hereby corrected as shown below:

Claim 1, column 5, line 4, change "will" to --wall--;

Claim 1, column 5, line 5, change "al" to --at--.

Signed and Sealed this

Third Day of April, 2001

*Attest:*

Nicholas P. Godici

NICHOLAS P. GODICI

*Attesting Officer*

*Acting Director of the United States Patent and Trademark Office*